US006656565B2

(12) United States Patent
Harrison

(10) Patent No.: US 6,656,565 B2
(45) Date of Patent: Dec. 2, 2003

(54) LOOFAH WASHCLOTH WITH GRIPPING AREA

(76) Inventor: Charlie Harrison, 199 Malcolm X Blvd., New York, NY (US) 10026

( * ) Notice: Subject to any disclaimer, the term of this patent is extended or adjusted under 35 U.S.C. 154(b) by 9 days.

(21) Appl. No.: 09/962,491

(22) Filed: Sep. 25, 2001

(65) Prior Publication Data

US 2003/0059571 A1 Mar. 27, 2003

(51) Int. Cl.[7] ..... B32B 3/10

(52) U.S. Cl. ..... 428/131; 428/136; 428/137; 428/102; 15/229.12; 15/229.13; 15/209.1; 15/210.1

(58) Field of Search ..... 15/227, 229.12, 15/229.13, 209.1, 210.1, 222; 300/21; 2/158; 229/11; 4/606; 428/102, 131, 137, 136

(56) References Cited

U.S. PATENT DOCUMENTS 5,251,990 A * 10/1993 Vought et al. ..... 401/8
5,386,609 A * 2/1995 Xenos ..... 15/222
5,916,408 A * 6/1999 Chen ..... 156/308.4
D427,728 S * 7/2000 Ferguson ..... D29/118
6,223,382 B1 * 5/2001 Schwab ..... 15/222

* cited by examiner

*Primary Examiner*—Harold Pyon
*Assistant Examiner*—Jane Rhee
(74) *Attorney, Agent, or Firm*—Steven Horowitz

(57) ABSTRACT

A two-sided washcloth is made of a sheet of loofah that is lined on an outside perimeter with cloth. The washcloth has a convenient set of parallel spaced-apart linear openings also lined with cloth. The surface area of the loofah between the linear openings together with the lining around the openings constitutes a holding area for pressing the back one's hand against after inserting four fingers of a person's hand through both linear openings. The grip is secured by maintaining the thumb on the near side of the first opening. The grip permits both sides of the sheet comprising the washcloth to be applied to the body conveniently, thereby assuring maximum use of the loofah.

20 Claims, 2 Drawing Sheets

FIG. 1
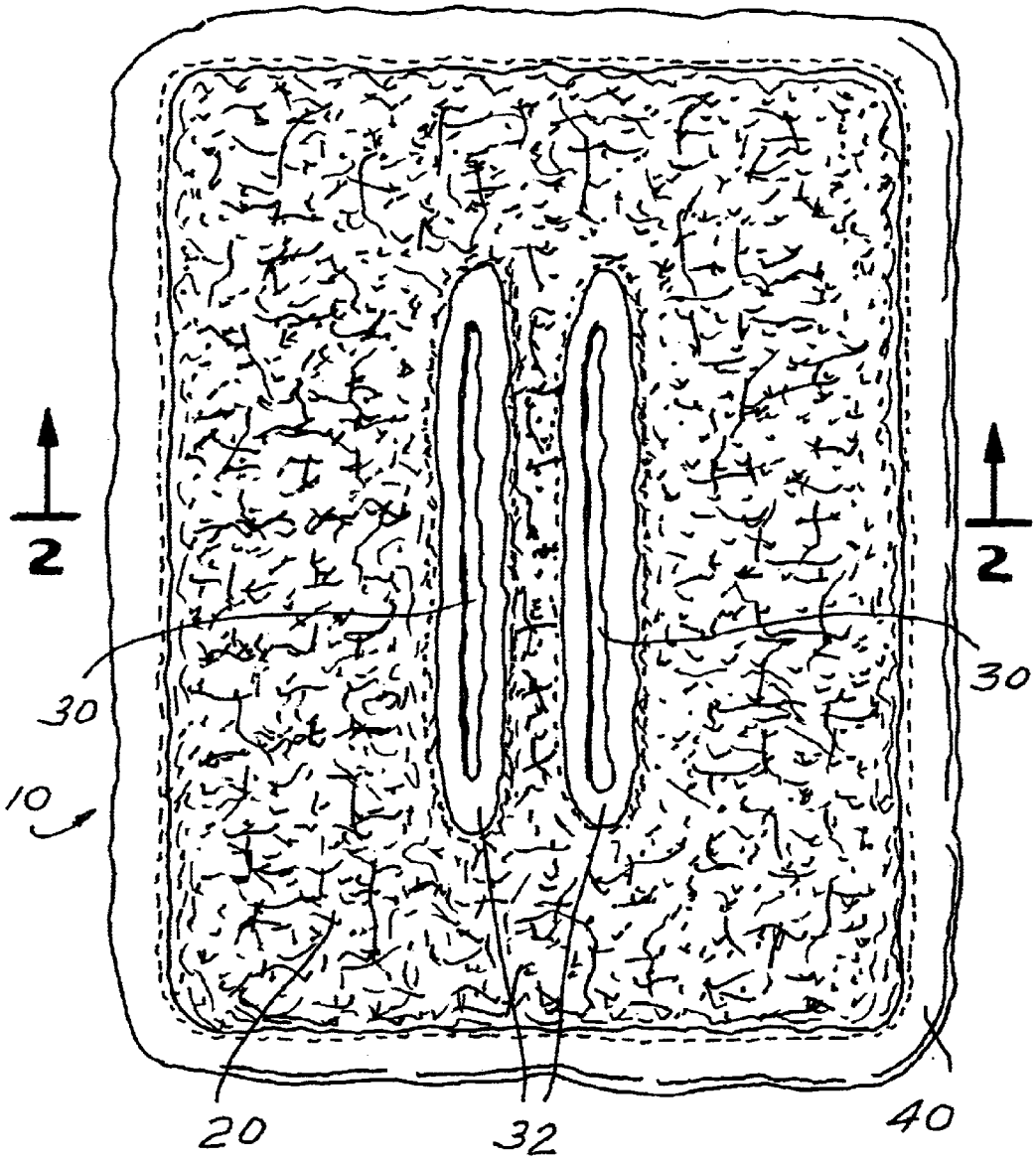
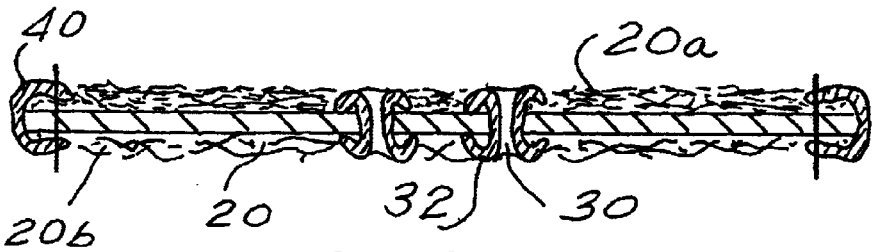
FIG. 2

FIG. 3
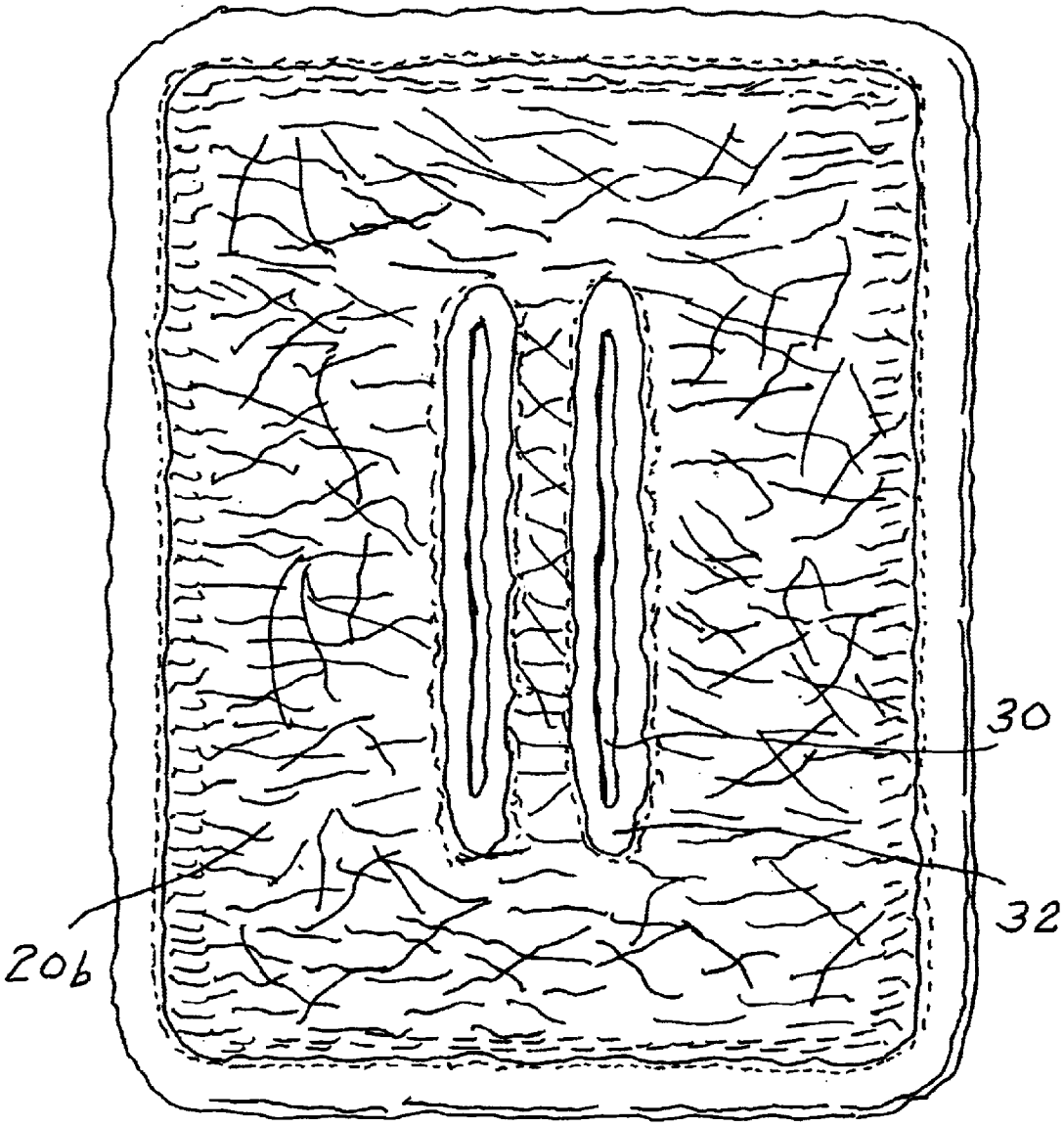
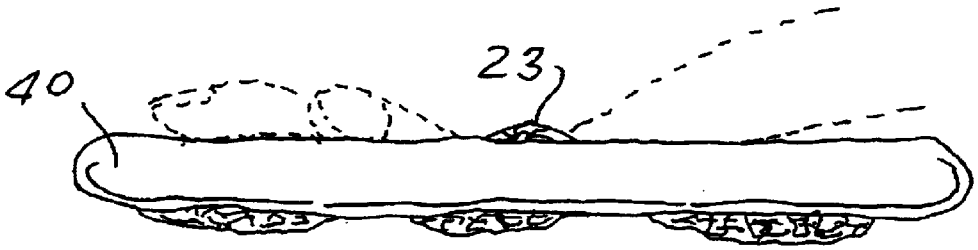
FIG. 4

LOOFAH WASHCLOTH WITH GRIPPING AREA

The present invention relates to wash cloths for cleaning and washing the skin, and more particularly, to such washcloths that are made of loofah.

Washcloths for scrubbing, cleaning and/or washing the skin are very well known. Also known is the use of loofah as a beneficial material in washcloths and sponges that are used to scrub, wash and clean the skin throughout the body. Existing loofah washcloths, however, have no convenient means of gripping. As a result, it is not easy to make full use of the washcloth and hence the portion of the washcloth available for use at any one time is restricted. This is because normal use of the washcloth entails having the thumb and four additional fingers (sometimes fewer) of the user's hand positioned on the washcloth to grip it. This kind of normal grip necessarily entails having a large number of fingers covering a significant portion of the washcloth or sponge. Furthermore, this kind of grip often involves bending and creasing the washcloth. Both the direct blocking and the creasing interferes with the application of the full surface area of the washcloth on the skin at any one time. The fact that by changing one's grip constantly it is possible to shift to previously unused portions of the washcloth does not eliminate the problem. It is cumbersome and inconvenient to constantly do so.

Moreover, since washcloths made of loofah are superior for scrubbing and since scrubbing involves the application of a lot of force, it is particularly disadvantageous to be forced to change one's grip constantly when scrubbing with a loofah washcloth. It would be advantageous to have a loofah washcloth that can be gripped in a convenient manner that allows the user to make use of the full surface area of the washcloth. Furthermore it would be particularly useful to make full use of both sides of the washcloth without having to constantly change one's grip. The present invention provides these advantages and others.

SUMMARY OF THE INVENTION

A two-sided washcloth is made of a sheet of loofah that is lined on an outside perimeter with cloth. The washcloth has a convenient set of parallel spaced-apart linear openings also lined with cloth. The surface area of the loofah between the linear openings together with the lining around the openings constitutes a holding area for pressing the back one's hand against after inserting four fingers of a person's hand through both linear openings. The grip is secured by maintaining the thumb on the near side of the first opening. The grip permits both sides of the sheet comprising the washcloth to be applied to the body conveniently, thereby assuring maximum use of the loofah.

IMPORTANT OBJECTS AND ADVANTAGES

The following important objects and advantages of the present invention are:

(1) to provide a washcloth made of loofah which is especially beneficial for scrubbing, cleaning and washing human skin;

(2) to provide a washcloth made of loofah in which the full surface area of the washcloth can be used conveniently;

(3) to provide a washcloth made of loofah that can be gripped conveniently and held in a manner that allows use of the full surface area of the washcloth without having to constantly change one's grip; and (4) to provide a washcloth that has both sides as usable surfaces.

BRIEF DESCRIPTION OF THE DRAWINGS

FIG. 1 is a front view of the washcloth of the present invention.

FIG. 2 is a cross-section view of the washcloth of the present invention taken along line 2—2 of FIG. 1.

FIG. 3 is a rear view of the washcloth of the present invention.

FIG. 4 is a side view of the washcloth of the present invention shown held by a user.

DETAILED DESCRIPTION OF THE PREFERRED EMBODIMENT

In order to better understand the present invention in conjunction with the drawings of FIGS. 1–4, the overall washcloth of the present invention has been assigned reference numeral 10 and its elements are described and assigned the reference numerals identified below.

As best seen in FIGS. 1–4, washcloth 10 is comprised of a two-sided sheet 20 of a fibrous scrubbing material, such as loofah, together with a cloth border 40 stitched to loofah sheet 20. Loofah sheet 20 has usable upper surface 20*a* and usable lower surface 20*b*. Cloth outer border 40 is for reinforcement and for maintaining smoothness and it spans the thickness of sheet 20 from upper surface 20*a* to lower surface 20*b* of sheet 20. The present invention also contemplates eliminating cloth outer border 40 or replacing it with other suitable reinforcement materials.

Sheet 20 is preferably substantially rectangular with rounded corners or is rounded. Alternatively, sheet 20 can also be shaped in other shapes such as oval. If sheet 20 is rectangular, openings 30 should be substantially parallel to the sides of the rectangular sheet 20. Both a reinforcing lining border 32 around elongated opening 30 and cloth outer border 40 are attached to the loofah sheet 20 by means of stitching, although other suitable forms of attachment are contemplated. Reinforcing lining border 32 should not be attached in a way that interferes with the overall smoothness of the surface of washcloth 10.

The term "substantially rectangular" as applied to sheet 20 shall mean that the corners of sheet 20 may have rounded earners and the sheet is otherwise rectangular, as seen in FIGS. 1 and 3. The term "substantially parallel" as applied to the elongated openings 30 shall mean that these elongated openings are situated so that they are between approximately 179 and 180 degree angles from one another. This is visible from FIGS. 1 and 3 in which the openings 30 are not exact straight lines.

The loofah material, a sponge comprised of the fibrous skeleton of the fruit of a tropical plant of the gourd family, is especially beneficial for scrubbing, washing, cleaning and rubbing human skin. Loofah also stimulates the skin when used for these purposes. Besides these features, the loofah material also has the advantage of having the desired amount of stiffness needed. Sheet 20 of the present invention made of loofah is not so stiff that it is uncomfortable when applied to the human skin with force, as is done during scrubbing. On the other hand, the loofah sheet 20 is sufficiently stiff that sheet 20 maintains its shape when gripped in the manner described below using openings 30. A traditional cloth washcloth would not be stiff enough to maintain its shape under similar circumstances. When sheet 20 is wetted before use, it becomes slightly less stiff but still remains stiff enough so that it maintains its shape when gripped in the manner described below using opening 30.

Sheet 20 has formed within it two parallel elongated openings 30. The elongated openings 30 have a cloth lining border 32 to maintain a uniform shape for the openings 30 and to provide reinforcement. Although the present invention refers at times to a cloth lining border 32, the present invention is not limited to openings 30 having cloth lining border 32 but rather includes any reinforcing material or fabrics, such as a fabric lining border 32 or other reinforcing lining border 32 comfortable to the skin, besides cloth that achieves the above reinforcement and uniformity purposes. Although not necessarily ideal, the present invention also contemplates omitting cloth lining border 32 altogether provided loofah sheet 20 can be made to have a uniform edge where openings 30 begin that is comfortable for the user's hands.

Cloth lining border 32 for each elongated opening 30 covers the point where the loofah material of sheet 20 ends and that elongated opening 30 begins. Each of elongated openings 30 should be at least one handbreadth long to allow insertion of four fingers of one's hand. Elongated openings 30 should also be long enough so as to interfere only minimally with the application of the loofah sheet 20 to the skin. Hence openings 30 traverse only a portion of the breadth of sheet 20. Openings 30 should also be centered in sheet 20. Elongated openings are centered in a length of sheet 20 and in a width of sheet 20 to obtain the maximum control over washcloth 10. As is clearly shown in FIGS. 1–3, elongated openings 30 traverse the frill thickness of sheet 20.

Let us assume that the user wishes to apply lower surface 20*b* to the skin. The portion of the surface 22 of loofah 20 that is located between the elongated openings together with the cloth lining border 32 forms a gripping area 23 in the center of the upper surface 22*a* of sheet 20. The gripping area is helpful because a user can insert four or fewer fingers of the user's hand through both elongated openings 30 and then maintain the grip by pressing the back of the hand against the gripping area 23 while maintaining the thumb of the same hand on a surface area of upper surface 20*b* of loofah sheet 20 outside the gripping area.

With the grip configuration afforded by the washcloth 10 of the present invention, the user can apply almost all of lower surface 20*b* of loofah sheet 20 to the skin and scrub the skin with force. The five fingers are actually adjacent upper surface 20*a* and almost all of surface 20*b* is usable for scrubbing against the skin. Furthermore, sheet 20 can be used on each of its two surfaces 20*a*, 20*b*. The same description of the procedure and advantages of washcloth 10 applies if the user wishes to apply upper surface 20*b* to the skin except that in that case the user would grip washcloth 10 on lower surface 20*b* of sheet 20 since sheet 20 can be easily turned upside down.

It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A washcloth, comprising:

a two-sided sheet of fibrous scrubbing material for scrubbing human skin, the sheet having a usable upper surface and a usable lower surface, two substantially parallel elongated openings in the sheet, each opening at least one handbreadth long, said elongated openings having a reinforcing lining border and traversing a portion of a breadth of the sheet, the elongated openings being centered in a length of the sheet and being centered in a width of the sheet and said elongated openings traversing a full thickness of the sheet, a surface area of a loofah between the elongated openings together with the reinforcing lining border forming a gripping area so that a user is able to insert four fingers of a hand through both elongated openings and press a back of the hand against the gripping area while maintaining a thumb of the hand on a surface area of the loofah outside the gripping area.

2. The washcloth of claim 1, wherein the fibrous scrubbing material is loofah.

3. The washcloth of claim 2, wherein the reinforcing lining border is made of fabric.

4. The washcloth of claim 2, wherein the sheet is substantially rectangular.

5. A washcloth, comprising:

a two-sided sheet of fibrous scrubbing material for scrubbing human skin, the sheet having a usable upper surface and a usable lower surface, an outside border surrounding the sheet of fibrous scrubbing material and spanning a thickness of the sheet from the upper surface to the lower surface of the sheet, two substantially parallel elongated openings in the sheet, each opening at least one handbreadth long, said elongated openings having a reinforcing lining border and traversing a portion of a breadth of the sheet, the elongated openings being centered in a length of the sheet and being centered in a width of the sheet and said elongated openings traversing a full thickness of the sheet, a surface area of the fibrous scrubbing material between the elongated openings together with the reinforcing lining border forming a gripping area so that a user is able to insert four fingers of a hand through both elongated openings and press a back of the hand against the gripping area while maintaining a thumb of the hand on a surface area of the fibrous scrubbing material outside the gripping area.

6. The washcloth of claim 5, wherein the fibrous scrubbing material is loofah.

7. The washcloth of claim 6, wherein the reinforcing lining border is made of fabric.

8. The washcloth of claim 6, wherein the sheet is substantially rectangular.

9. The washcloth of claim 6, wherein the outside border is stitched to an outer perimeter of the loofah.

10. The washcloth of claim 6, wherein the outside border is made of cloth.

11. A washcloth, comprising:

a two-sided sheet of fibrous scrubbing material for scrubbing human skin, the sheet having a usable upper surface and a usable lower surface, two substantially parallel elongated openings in the sheet, each opening at least one handbreadth long, said elongated openings having a reinforcing lining border and traversing a portion of a breadth of the sheet, the elongated openings being centered in either a length of the sheet or in a width of the sheet and said elongated openings traversing a full thickness of the sheet, a surface area of a loofah between the elongated openings together with the reinforcing lining border forming a gripping area so that a user is able to insert four fingers of a hand through both elongated openings and press a back of the hand against the gripping area while maintaining a thumb of the hand on a surface area of the loofah outside the gripping area.

12. The washcloth of claim 11, wherein the fibrous scrubbing material is loofah.

13. The washcloth of claim 12, wherein the reinforcing lining border is made of fabric.

14. The washcloth of claim 12, wherein the sheet is substantially rectangular.

15. A washcloth, comprising:

a two-sided sheet of fibrous scrubbing material for scrubbing human skin, the sheet having a usable upper surface and a usable lower surface, an outside border surrounding the sheet of fibrous scrubbing material and spanning a thickness of the sheet from the upper surface to the lower surface of the sheet, two substantially parallel elongated openings in the sheet, each opening at least one handbreadth long, said elongated openings having a reinforcing lining border and traversing a portion of a breadth of the sheet, the elongated openings being centered in either a length of the sheet or in a width of the sheet and said elongated openings traversing a full thickness of the sheet, a surface area of the fibrous scrubbing material between the elongated openings together with the reinforcing lining border forming a gripping area so that a user is able to insert four fingers of a hand through both elongated openings and press a back of the hand against the gripping area while maintaining a thumb of the hand on a surface area of the fibrous scrubbing material outside the gripping area.

16. The washcloth of claim 15, wherein the fibrous scrubbing material is loofah.

17. The washcloth of claim 16, wherein the reinforcing lining border is made of fabric.

18. The washcloth of claim 16, wherein the sheet is substantially rectangular.

19. The washcloth of claim 16, wherein the outside border is stitched to an outer perimeter of the loofah.

20. The washcloth of claim 16, wherein the outside border is made of cloth.

* * * * *